US006439502B1

(12) United States Patent
Gemmell et al.

(10) Patent No.: US 6,439,502 B1
(45) **Date of Patent: *Aug. 27, 2002**

(54) DISPENSER FOR CORELESS ROLLS OF PRODUCTS

(75) Inventors: Bruce McLean Gemmell, Wilmington, DE (US); Joseph Mitchell, Alpharetta, GA (US)

(73) Assignee: Kimberly-Clark Worldwide, Inc., Neenah, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/929,283

(22) Filed: Sep. 8, 1997

Related U.S. Application Data

(63) Continuation-in-part of application No. 08/395,327, filed on Feb. 28, 1995, now Pat. No. 5,697,576, and a continuation-in-part of application No. 08/843,670, filed on Apr. 10, 1997, now Pat. No. 6,070,821, which is a continuation of application No. 08/402,341, filed on Mar. 10, 1995, now Pat. No. 5,620,148.

(51) Int. Cl.[7] ..... B65H 16/06

(52) U.S. Cl. ..... 242/596.3; 242/422.4; 242/596.7; 242/596.8

(58) Field of Search ..... 242/596.3, 596.7, 242/596.8, 422.4, 422.9; 312/34.8

(56) References Cited

U.S. PATENT DOCUMENTS

| | | | |
|---|---|---|---|
| 390,084 A | 9/1888 | Lane | 242/596.3 |
| 419,811 A | 1/1890 | Zerr | 242/423 |
| 498,900 A | 6/1893 | Hicks | |

(List continued on next page.)

FOREIGN PATENT DOCUMENTS

| | | |
|---|---|---|
| CA | 833971 | 2/1970 |
| CA | 928671 | 6/1973 |
| CA | 2190806 | 6/1997 |
| DE | 1194670 | 6/1965 |
| EP | 0 089 933 | 9/1983 |

(List continued on next page.)

OTHER PUBLICATIONS

JP 8196469 A (Abstract Only); Assignee: Sekisui Chem Ind Co. Ltd.; Mar. 4, 1991.

JP 8333041 A (Abstract Only); Assignee: Taisei Tekkosho KK; Dec. 17, 1996.

(List continued on next page.)

*Primary Examiner*—John Q. Nguyen

(57) ABSTRACT

A dispenser for a coreless roll product having a pair of depressions defined in the ends of the coreless roll. The dispenser includes: a frame; mounting device for permitting the frame to be mounted to a stationary surface such as a wall; and a coreless roll securing device for securing a coreless roll product for rotation within the frame. The coreless roll securing device includes a pair of cooperating plungers. Each plunger includes: (1) a base, the base being fixed to the frame; (2) a distal end, the distal end having a radius of curvature; and (3) a central shaft, the central shaft connecting the base and the distal end and providing sufficient length so the plunger has a length at least as great as its widest dimension so the plunger is adapted to penetrate a depression defined at an end of a coreless roll product, so radial displacement of the coreless roll with respect to said frame is prevented during use. Also a method for installing a coreless roll of a product.

20 Claims, 4 Drawing Sheets

U.S. PATENT DOCUMENTS

| | | | | | |
|---|---|---|---|---|---|
| 515,849 | A | | 3/1894 | Wheeler | |
| 1,217,211 | A | | 2/1917 | Pico | 242/596.4 |
| 1,229,431 | A | * | 6/1917 | Farrell | 242/596.3 |
| 1,778,282 | A | * | 10/1930 | Stewart | 242/596.3 |
| 2,049,964 | A | | 8/1936 | Lawson | 242/55.2 |
| 2,232,968 | A | | 2/1941 | Price et al. | 242/55.2 |
| 2,276,414 | A | | 3/1942 | Morehouse et al. | 242/55.5 |
| 2,299,626 | A | | 10/1942 | Hunt | 242/68 |
| 2,308,840 | A | | 1/1943 | Vaughan et al. | 242/55.2 |
| 2,380,644 | A | | 7/1945 | Grondona | 242/55.5 |
| 2,390,399 | A | | 12/1945 | Tator et al. | 242/55.2 |
| 2,555,885 | A | | 6/1951 | Hope | 242/55.2 |
| 2,566,883 | A | * | 9/1951 | Gove | 242/596.3 |
| 2,583,411 | A | | 1/1952 | Carlin | 242/55.2 |
| 2,643,069 | A | | 6/1953 | Carlin | 242/55.2 |
| 2,695,208 | A | | 11/1954 | Graham | 312/39 |
| 2,726,823 | A | | 12/1955 | Jespersen | 242/55.2 |
| 2,790,608 | A | * | 4/1957 | Sieven | 242/596.3 |
| 2,819,852 | A | | 1/1958 | Sarro | 242/55.53 |
| 2,830,775 | A | | 4/1958 | Kiesel | 242/56 |
| 2,839,346 | A | | 6/1958 | Lawalin | 312/39 |
| 2,845,231 | A | | 7/1958 | Grettve | 242/56 |
| 2,849,191 | A | | 8/1958 | Gadler | 242/56 |
| 2,872,263 | A | | 2/1959 | Andersson | 312/39 |
| 2,873,158 | A | | 2/1959 | Pinkham, Jr. | 312/39 |
| 2,879,012 | A | | 3/1959 | Sarro | 242/55.2 |
| 2,905,404 | A | | 9/1959 | Simmons | |
| 2,928,619 | A | | 3/1960 | Burlton et al. | |
| 2,939,645 | A | | 6/1960 | Rowlands et al. | 242/56 |
| 2,946,636 | A | | 7/1960 | Penney | 312/39 |
| 2,948,486 | A | | 8/1960 | Epeneter | |
| 3,004,693 | A | | 10/1961 | Johnson | 225/77 |
| 3,029,035 | A | | 4/1962 | Layton | 242/55.53 |
| 3,032,283 | A | | 5/1962 | Wooster | 242/55.2 |
| 3,034,739 | A | | 5/1962 | Barger | 242/68.4 |
| 3,038,598 | A | | 6/1962 | Layton et al. | 206/58 |
| 3,045,939 | A | | 7/1962 | VanderWaal | 242/56 |
| 3,084,006 | A | | 4/1963 | Roemer | 312/39 |
| RE25,828 | E | | 8/1965 | Wooster | 242/55.2 |
| 3,333,909 | A | | 8/1967 | Beker | 312/39 |
| 3,580,651 | A | | 5/1971 | Gauper | 312/39 |
| 3,729,145 | A | | 4/1973 | Koo et al. | 242/55.53 |
| 3,791,601 | A | | 2/1974 | Broden | 242/55.53 |
| 3,794,253 | A | * | 2/1974 | Megdall | 242/596.3 |
| 3,799,467 | A | | 3/1974 | Bauman | 242/55.2 |
| 3,802,639 | A | | 4/1974 | Dowd, Jr. | 242/81 |
| 3,823,887 | A | | 7/1974 | Gerstein | 242/56.2 |
| 3,826,361 | A | | 7/1974 | Heckrodt | 206/409 |
| 3,830,143 | A | | 8/1974 | Dowd, Jr. | 23/84 FF |
| 3,853,279 | A | | 12/1974 | Gerstein | 242/56.2 |
| 3,856,226 | A | | 12/1974 | Dowd, Jr. | 242/56 R |
| 3,878,998 | A | | 4/1975 | Lazzari | 242/55.2 |
| D238,462 | S | | 1/1976 | Bauman | D6/97 |
| D238,466 | S | | 1/1976 | Bauman | D6/97 |
| 4,013,236 | A | | 3/1977 | Perrin | 242/1 |
| 4,013,240 | A | | 3/1977 | Perrin | 242/55.53 |
| 4,032,077 | A | | 6/1977 | Baselice | 242/55.2 |
| 4,113,195 | A | | 9/1978 | Theunissen | 242/55.3 |
| 4,191,307 | A | | 3/1980 | LeCaire, Jr. et al. | 221/45 |
| 4,274,573 | A | | 6/1981 | Finkelstein | 225/106 |
| 4,289,262 | A | | 9/1981 | Finkelstein | 225/106 |
| 4,297,403 | A | | 10/1981 | Smith | 428/42 |
| 4,314,679 | A | | 2/1982 | Paul et al. | 242/55.3 |
| 4,383,656 | A | | 5/1983 | Campbell | 242/55.2 |
| 4,383,657 | A | | 5/1983 | Suh | |
| 4,410,221 | A | | 10/1983 | Vallis et al. | 312/39 |
| 4,467,974 | A | | 8/1984 | Crim | 242/55.53 |
| 4,487,378 | A | | 12/1984 | Kobayashi | 242/68 |
| 4,513,923 | A | | 4/1985 | Ulics | 242/55.2 |
| 4,535,947 | A | | 8/1985 | Hidle | 242/55.2 |
| 4,553,710 | A | | 11/1985 | Pool | |
| D283,188 | S | | 4/1986 | Pool | |
| 4,583,642 | A | | 4/1986 | Blythe et al. | 206/390 |
| 4,614,312 | A | | 9/1986 | Del Pino | 242/55.2 |
| 4,634,067 | A | | 1/1987 | White et al. | 242/55.2 |
| 4,659,028 | A | * | 4/1987 | Wren | 242/596.8 |
| 4,662,576 | A | | 5/1987 | Paul | 242/55.2 |
| 4,667,890 | A | | 5/1987 | Gietman. Jr. | 242/55 |
| 4,695,005 | A | | 9/1987 | Gietman, Jr. | 242/56 R |
| 4,757,952 | A | | 7/1988 | Balzer | 242/67.1 R |
| 4,760,970 | A | | 8/1988 | Larsson et al. | 242/55.54 |
| 4,767,075 | A | | 8/1988 | Peters et al. | 242/56 A |
| 4,783,015 | A | | 11/1988 | Shimizu | 242/1 |
| 4,792,105 | A | | 12/1988 | Imaseki | |
| 4,796,832 | A | | 1/1989 | Schutz et al. | |
| 4,807,825 | A | | 2/1989 | Elsner et al. | 242/56 R |
| 4,821,974 | A | | 4/1989 | Poehlein | |
| 4,832,271 | A | | 5/1989 | Geleziunas | 242/55.53 |
| 4,860,893 | A | | 8/1989 | Kaufman | 200/390 |
| 4,879,150 | A | | 11/1989 | Schutz et al. | |
| D316,201 | S | | 4/1991 | Shimasaki | D6/518 |
| D318,770 | S | | 8/1991 | Grisel | D6/523 |
| 5,058,792 | A | | 10/1991 | Morand | |
| 5,065,924 | A | | 11/1991 | Granger | 225/46 |
| 5,097,998 | A | | 3/1992 | Shimasaki | 225/106 |
| 5,100,075 | A | | 3/1992 | Morand | 242/55.2 |
| D326,580 | S | | 6/1992 | Brazis | |
| D327,193 | S | | 6/1992 | Crook | |
| D327,798 | S | | 7/1992 | Addison et al. | D6/523 |
| 5,149,003 | A | | 9/1992 | Tharp | |
| 5,161,793 | A | | 11/1992 | Lotto et al. | 271/182 |
| 5,170,938 | A | | 12/1992 | Dewing | 239/52 |
| 5,170,958 | A | | 12/1992 | Brown | 242/55.53 |
| 5,172,840 | A | | 12/1992 | Bloch et al. | |
| 5,197,727 | A | | 3/1993 | Lotto et al. | 271/183 |
| 5,205,455 | A | | 4/1993 | Moody | 225/106 |
| 5,215,211 | A | | 6/1993 | Eberle | 221/1 |
| 5,219,126 | A | | 6/1993 | Schutz | 242/55.42 |
| 5,253,818 | A | | 10/1993 | Craddock | 242/55.2 |
| 5,271,137 | A | | 12/1993 | Schutz | 29/400.1 |
| 5,271,575 | A | | 12/1993 | Weinert | 242/67.1 |
| 5,277,375 | A | | 1/1994 | Dearwester | 242/68.4 |
| 5,281,386 | A | | 1/1994 | Weinert | 264/512 |
| 5,310,129 | A | | 5/1994 | Whittington et al. | 242/55.3 |
| 5,314,131 | A | | 5/1994 | McCanless et al. | 242/55.3 |
| 5,322,234 | A | | 6/1994 | Robert et al. | |
| 5,352,319 | A | | 10/1994 | Ishizu et al. | 156/446 |
| 5,362,013 | A | | 11/1994 | Gietman, Jr. et al. | 242/521 |
| 5,366,175 | A | | 11/1994 | Schutz | 242/597.6 |
| 5,370,336 | A | | 12/1994 | Whittington | 242/560 |
| 5,370,339 | A | | 12/1994 | Moody et al. | 242/597.6 |
| 5,372,865 | A | | 12/1994 | Arakawa et al. | 428/40 |
| 5,385,318 | A | | 1/1995 | Rizzuto | 242/597.8 |
| 5,386,950 | A | | 2/1995 | Abt | 242/532 |
| 5,387,284 | A | | 2/1995 | Moody | 118/220 |
| 5,390,875 | A | | 2/1995 | Gietman, Jr. et al. | 242/521 |
| 5,402,960 | A | | 4/1995 | Oliver et al. | 242/527.1 |
| 5,407,509 | A | | 4/1995 | Ishizu et al. | 156/184 |
| 5,421,536 | A | | 6/1995 | Hertel et al. | 242/526.1 |
| 5,439,187 | A | | 8/1995 | Shimizu | 242/541.7 |
| 5,451,013 | A | | 9/1995 | Schutz | 242/597.4 |
| 5,453,070 | A | | 9/1995 | Moody | 493/288 |
| 5,454,500 | A | | 10/1995 | Chen | |
| 5,467,935 | A | | 11/1995 | Moody | 242/422.4 |
| 5,467,936 | A | | 11/1995 | Moody | 242/525.7 |
| 5,474,436 | A | | 12/1995 | Yamazaki | 425/103 |
| 5,480,060 | A | | 1/1996 | Blythe | 221/63 |
| 5,495,997 | A | | 3/1996 | Moody | 242/561 |
| 5,497,959 | A | | 3/1996 | Johnson et al. | 242/542.2 |
| 5,501,415 | A | | 3/1996 | Harris et al. | |
| 5,505,402 | A | | 4/1996 | Vigneau | 242/527.1 |

| | | | | |
|---|---|---|---|---|
| 5,509,593 | A | 4/1996 | Bloch et al. | |
| 5,513,478 | A | 5/1996 | Abt | 53/118 |
| 5,518,200 | A | 5/1996 | Kaji et al. | 252/538.1 |
| 5,524,835 | A | 6/1996 | Collins | |
| 5,538,199 | A | 7/1996 | Biagiotti | 242/541.2 |
| 5,542,622 | A | 8/1996 | Biagiotti | 242/521 |
| 5,577,686 | A | 11/1996 | Moody | 242/597.4 |
| 5,597,135 | A | 1/1997 | Vandersteene | |
| 5,601,253 | A | 2/1997 | Formon et al. | |
| 5,603,467 | A | 2/1997 | Biagiotti | 242/521 |
| 5,609,269 | A | 3/1997 | Behnke et al. | 221/48 |
| 5,611,455 | A | 3/1997 | McCreary | 221/45 |
| 5,618,008 | A | 4/1997 | Dearwester et al. | 242/594.5 |
| 5,620,148 | A | 4/1997 | Mitchell | 242/160.4 |
| 5,620,544 | A | 4/1997 | Cram et al. | 156/184 |
| 5,636,812 | A | 6/1997 | Connor et al. | 242/559.2 |
| 5,639,046 | A | 6/1997 | Biagiotti | 242/541.2 |
| 5,642,810 | A | 7/1997 | Warner et al. | 206/389 |
| 5,645,244 | A | 7/1997 | Moody | |
| 5,660,349 | A | 8/1997 | Miller et al. | 242/526.1 |
| 5,669,576 | A | 9/1997 | Moody | 242/560.3 |
| 5,676,331 | A | 10/1997 | Weber | |
| 5,690,296 | A | 11/1997 | Biagiotti | 242/521 |
| 5,697,576 | A | 12/1997 | Bloch et al. | 242/596.8 |
| 5,722,608 | A | 3/1998 | Yamazaki | 242/160.1 |
| 5,725,176 | A | 3/1998 | Vigneau | 242/521 |
| 5,727,883 | A | 3/1998 | Kusano et al. | |
| 5,730,387 | A | 3/1998 | Yamazaki | 242/532.3 |
| 5,746,379 | A | 5/1998 | Shimizu | 242/160.1 |
| 5,794,882 | A | 8/1998 | Lewis | 242/423.1 |
| 5,797,559 | A | 8/1998 | Coffey | 242/527.6 |
| 5,829,710 | A | 11/1998 | Halle et al. | |
| 5,833,169 | A | 11/1998 | Morand | |
| 5,839,680 | A | 11/1998 | Biagiotti | 242/160.1 |
| 5,848,762 | A | 12/1998 | Reinheimer et al. | 242/595 |
| 5,849,357 | A | 12/1998 | Andersson | 427/179 |
| 5,857,642 | A | 1/1999 | Zinnbauer | |
| 5,868,275 | A | 2/1999 | Moody | 221/33 |
| 5,868,335 | A | 2/1999 | Lebrun | |
| 5,868,342 | A | 2/1999 | Moody et al. | 242/560 |
| 5,868,347 | A | 2/1999 | Paul et al. | |
| 5,875,985 | A | 3/1999 | Cohen et al. | 242/160 |
| 5,895,008 | A | 4/1999 | Sanders | 242/541.2 |
| 5,904,316 | A | 5/1999 | Dunning et al. | 242/595 |
| 5,954,256 | A | 9/1999 | Niada | |
| 5,996,931 | A | 12/1999 | Neveu et al. | |
| 6,070,821 | A | 6/2000 | Mitchell | |
| D428,286 | S | 7/2000 | Phelps et al. | |
| 6,082,664 | A | 7/2000 | Phelps et al. | |
| 6,092,758 | A | 7/2000 | Gemmell | |
| 6,092,759 | A * | 7/2000 | Gemmell et al. | 242/596.8 |

FOREIGN PATENT DOCUMENTS

| | | | |
|---|---|---|---|
| EP | 0618159 | A2 | 2/1994 |
| EP | 0589481 | A1 | 3/1994 |
| EP | 0589481 | A1 | 3/1994 |
| EP | 0608046 | A1 | 7/1994 |
| EP | 0698367 | A1 | 2/1996 |
| EP | 0729724 | A1 | 9/1996 |
| EP | 0842881 | A2 | 5/1998 |
| GB | 1248002 | | 9/1971 |
| GB | 2 120 206 | A | 11/1983 |
| GB | 2 244 472 | A | 12/1992 |
| GB | 2 276 107 | A | 9/1994 |
| GB | 2 294 681 | A | 5/1996 |
| WO | 93/21094 | | 10/1993 |
| WO | 94/27483 | | 12/1994 |
| WO | 94/29205 | | 12/1994 |
| WO | 95/01929 | | 1/1995 |
| WO | 95/08940 | | 4/1995 |
| WO | 95/13183 | | 5/1995 |
| WO | 96/26878 | | 9/1996 |
| WO | 96/27546 | | 9/1996 |
| WO | 96/28079 | | 9/1996 |
| WO | 99/12462 | | 3/1999 |

OTHER PUBLICATIONS

JP 8333055 A (Abstract Only); Assignee: Uchinami KK; Dec. 17, 1906.

JP 9118455 A (Abstract Only); Assignee: Taisei Tekkosho KK; May 6, 1997.

JP 9216755 A (Abstrsct Only); Assignee: Yamazaki T; Aug. 19, 1997.

JP 9323849 A (Abstract Only); Assignee: Taisei Tekkosho KK; Dec. 16, 1997.

TW 293002 A (Abstract Only); Assignee: Minnesota Mining & Mfg. Co.; Dec. 11, 1996.

PCT Counterpart International Search Report, mailed Dec. 15, 1998.

* cited by examiner

DISPENSER FOR CORELESS ROLLS OF PRODUCTS

This application is a continuation-in-part of application Ser. No. 08/395,327, entitled "System And Method Of Dispensing Coreless Rolls Of Paper Products" and filed in the U.S. Patent and Trademark Office on Feb. 28, 1995 now U.S. Pat. No. 5,697,576. This is also continuation of application Ser. No. 08/843,670, entitled "Indented Coreless Roll And Method Of Making And Using The Same" and filed in the U.S. Patent and Trademark Office on Apr. 10, 1997 now U.S. Pat. No. 6,070,821, which was a continuation of application Ser. No. 08/402,341, entitled "Method Of Making Indented Coreless Rolls" and filed in the U.S. Patent and Trademark Office on Mar. 10, 1995, now U.S. Pat. No. 5,620,148. The entirety of the applications are hereby incorporated by reference.

FIELD OF THE INVENTION

This invention pertains to the field of commercial and consumer roll form products such as, for example, absorbent paper products, and which includes toilet tissue and paper towels. More specifically, this invention relates to an improved dispenser and method of dispensing a coreless roll of absorbent paper product.

BACKGROUND OF THE INVENTION

Commercial and consumer absorbent products such as shop towels, nonwoven fabrics, wipers, toilet tissue and paper towels are often distributed and dispensed in roll format. Most products in this format include a cylindrical core at the center of the roll. Typically, the product is wrapped about the core. Most roll format product dispensers require this core to function properly. The core is usually some type of cardboard tube, plastic tube, or solid spindle which is glued to the product so that the product does not separate from the core.

Product is normally loaded by mounting the roll on a spindle in a manner similar to the ubiquitous bathroom toilet roll dispenser. The spindle passes through or otherwise penetrates the inner space of the core. Some dispensers include pegs that penetrate the hollow space within the core for only a limited extent, as demonstrated in U.S. Pat. Nos. 390,084 and 2,905,404 to Lane and Simmons, respectively Recently, coreless rolls of products such as, for example, toilet tissue have appeared on the market, primarily in Europe. These coreless rolls are wound throughout the entire diameter of the roll. There are advantages and disadvantages associated with the coreless rolls. Coreless rolls are ecologically superior to cored rolls because they lack the central core made of plastic, cardboard or other material. In addition, more product can be provided in the space that would otherwise have been occupied by the core.

Cored rolls are more expensive to manufacture than coreless rolls because of the expense of making the cores and joining the cores to the product. In addition, coreless rolls have the advantage of being less subject to pilferage in commercial locations because of their inherent incompatibility with conventional dispensers.

On the other hand, coreless roll products have dispensing problems that are difficult to overcome. Coreless rolls do not fit into conventional core roll dispensers. Moreover, even though coreless rolls are less likely to be pilfered because they are incompatible with conventional dispensing systems, the lack of a core and spindle passing through the product that can be locked makes it relatively difficult to keep the coreless format product secure.

Conventional dispensers for coreless rolls typically include an enclosed surface that supports the roll as it turns, and an opening through which the product is passed. While functional, these dispensers have some undesirable characteristics, including an inability to control drag resistance to withdrawal of the product; the fact that the product actually touches the inside of the dispenser, which might be considered unsanitary by some consumers; and an inability to provide 180 degree product access to the consumer. Some dispensers for coreless rolls have pressure plates and pins that project into the side of the roll between the layers of product. It can be difficult to center the roll during loading of these dispenser without a centering device and the pressure plate and pins can easily be pried back to release the roll from the dispenser.

Accordingly, it is clear that a need exists for a coreless roll dispenser that can secure a coreless roll against pilferage. There is a further need or a dispenser that can dispense coreless rolls of absorbent consumer and commercial paper products so they can be secured against pilferage.

SUMMARY OF THE INVENTION

The problems described above are addressed by the present invention which encompasses a dispenser for a coreless roll product having a pair of depressions defined in the ends of the coreless roll. The dispenser includes: a frame; mounting means for permitting the frame to be mounted to a stationary surface such as a wall; and a coreless roll securing means for securing a coreless roll product for rotation within the frame. The coreless roll securing means includes a pair of cooperating plungers. Each plunger includes: (1) a base, the base being fixed to the frame; (2) a distal end, the distal end having a radius of curvature; and (3) a central shaft, the central shaft connecting the base and the distal end and providing sufficient length so the plunger has a length at least as great as its widest dimension so the plunger is adapted to penetrate a depression defined at an end of a coreless roll product, so radial displacement of the coreless roll with respect to said frame is prevented during use.

The mounting means for the dispenser may be, for example, an opening defined in the frame for a securing member such as a bolt. Other mounting means, such as clips, pins, screws, latches and the like may also be used.

In an embodiment of the present invention, the coreless roll securing means may further include a pair of opposed arms that are connected to the frame. In such an embodiment, there is mounted to an inner side of each arm is a plunger including: (1) a base, the base being fixed to the frame; (2) a distal end, the distal end may desirably have a radius of curvature; and (3) a central shaft, the central shaft connecting the base and the distal end and providing sufficient length so the plunger has a length at least as great as its widest dimension so the plunger is adapted to penetrate a depression defined at an end of a coreless roll product, whereby radial displacement of the coreless roll with respect to said frame is prevented during use.

The dispenser may further include biasing means for resiliently biasing at least one of the opposed arms toward the coreless roll. The biasing means may be in the form of at least one of the opposed arms being constructed out of a resilient material, so that arm (or In an aspect of the present invention, the pair of opposed arms may be adapted to pivot apart from each other to define a loading position and pivot toward each other to define a dispensing position.

The dispenser may further include a locking means for locking the opposed arms at the dispensing position. For example, the locking means may be a cover that surrounds the opposed arms. Alternatively and/or additionally, the locking means may be any conventional locking mechanism including, but not limited to, latches, clips, pins, ratchets, jaws and the like.

The plunger may have cross-section that is circular, triangular, square, diamond, semi-circular, "X", "Y" or "T"-shaped or the like. It is desirable that the plunger has a cross-section width of at least 1 centimeter. If the plunger has a circular cross-section, it is desirable that the diameter be at least 1 centimeter.

The distal end of the plunger may have a radius of curvature and desirably defines a hemisphere. Of course, other geometries are contemplated for the shape of the distal end of the plunger. It is also contemplated that the plunger may have a narrow width or a variable width.

The distal end of the plunger should extend from its base a sufficient distance to penetrate the depression at the end of the coreless roll. Generally speaking, the distal end of the plunger extends from its base a distance that is at least equal to or greater than the width of the plunger. Desirably, that distance is from about 1.0 to about 2.0 times the width of the plunger. For example, if the plunger has a cross-section width of about 1 centimeter, it is desirable for the distal end of the plunger to extend more than about 1 centimeter or more from its base. As a further example, the distal end of the plunger may desirably extend for 1.25 centimeters, 1.5 centimeters, 1.75 centimeters, or 2.0 centimeters. Generally speaking, a greater extension of the plunger helps provides greater penetration into the depressions defined at the ends of the coreless roll product and helps to prevent pilferage of the coreless roll product from the dispenser.

The present invention also encompasses a method of installing a coreless roll of product having a pair of depressions defined at opposite ends of the roll into a dispenser. The method includes the steps of:

- displacing at least one of a pair of opposed plungers to a loading position;
- orienting a coreless roll with a pair of depressions at opposite ends of the roll so each depression is adjacent each plunger; and
- securing the coreless roll to the dispenser by returning at least one of the pair of opposed plungers to a dispensing position whereby the plungers penetrate the respective depressions in the coreless roll.

According to the method of the present invention, the displacing step may involve displacing both of the opposed plungers into a loading position. In an embodiment, the securing step may involve returning both of the opposed plungers to a dispensing position.

The method of the present invention may further include the step of resiliently biasing the plungers into the coreless roll during operation.

In an aspect of the method of the present the displacing and securing steps may involve moving at least one of a pair of opposed arms. For example, the displacing and securing steps may involve moving a pair of opposed arms.

Another aspect of the method of the present invention further includes the step of locking at least one of a pair of opposed arms in a dispensing position. This locking may be accomplished by covering the arms with a cover or by conventional locking means such as, for example, a cam, lever, ratchet, cotter pin or the like. The locking means may be activated by a key or pin.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION

Figure 1:
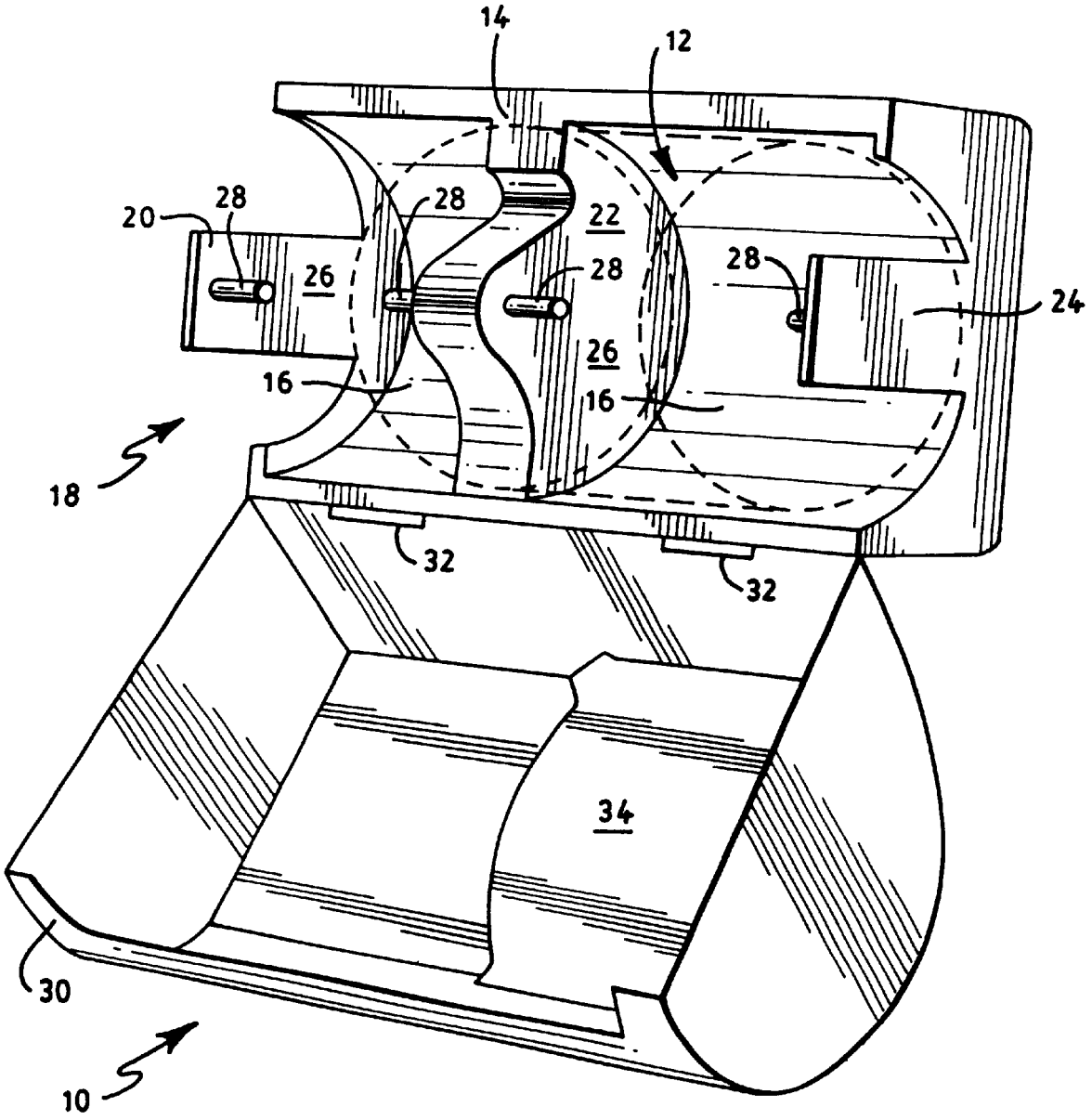
FIG. 1 is an illustration of an exemplary coreless roll product dispenser.

Referring now to the drawings, wherein like reference numerals designate corresponding structure throughout the views, and referring in particular to FIG. 1, there is shown (not necessarily to scale) an illustration of an exemplary dispenser for a coreless roll product having a pair of depressions defined in the ends of the coreless roll.

Many different types of products may be produced in a coreless roll format. For example, commercial and consumer absorbent products such as shop towels, nonwoven fabrics, wipers, bathroom tissue and paper towels are often distributed and dispensed in roll format. There is shown at FIG. 1 a dispenser 10 for dispensing coreless roll products 12 (shown in broken lines) having a pair of depressions defined in the ends of the coreless roll.

The dispenser 10 includes a frame 14 that has mounting holes 16 defined therein for permitting the frame to be mounted to a stationary surface, such as a wall. The dispenser 10 further includes a coreless roll securing mechanism 18 for securing a coreless roll 12 of product (e.g., bathroom tissue) for rotation within the frame 14. In the embodiment shown in FIGS. 1, the coreless roll securing mechanism 18 includes a first arm 20, a second, central arm 22 and a third arm 24.

While the present invention is described in terms of a dispenser having arms connected to a frame, it should be understood that other embodiments of the present invention are possible. For example, some dispensers may have sides instead of arms. In either case, the arms or sides are separated by a distance that is slightly greater than the width of the roll of the core roll product to be dispensed.

The dispenser 10 depicted in FIG. 1 is designed to accommodate two rolls of coreless roll product (e.g., bathroom tissue), much in the manner of many conventional dispensers that are available for commercial application. Desirably, the outer arms 20, 24 may be made of a resilient material, such as spring steel, and are configured so they will be slightly displaced when a coreless roll is secured between the central arm 22 and the respective outer arms 20, 24. In this way, the outer arms 20, 24 will bias the respective coreless roll 20 toward the central arm 22.

In some embodiments of the invention, the outer arms 20, 24 are constructed so they are rigid and will not move. In that case, a hinge or pivot at the base of the outer arms or at some other position on the outer arms is used so the arms may be moved outward (i.e., away from the central arm 22) to a loading position and inward (i.e., toward the central arm 22) to a dispensing position.

Figure 2:
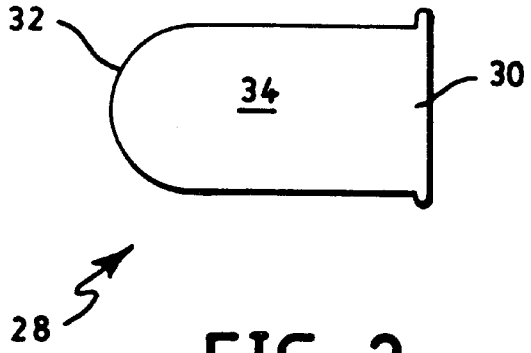
FIG. 2 is an illustration of a detail of an exemplary coreless roll product dispenser.

One important advantage of the invention is that the coreless roll securing mechanism 18 is designed to prevent radial displacement of the coreless rolls 12 with respect to the frame 14 of the dispenser 10 during use, so that a coreless roll can be dispensed without fear of radial displacement during use as confidently as a conventional cored roll of absorbent paper product can be dispensed. This is achieved by providing plungers 28 on inner surfaces 26 of the respective arms 20, 22, 24 of the securing mechanism 18. Referring now to FIG. 2, there is shown an exemplary plunger 28. Each plunger 28 is configured to have a base 30, a distal end 32 and a central shaft 34.

Generally speaking, the base 30 is affixed to the outer arms 20 and 24 and the central arm 22 of the dispenser. It is contemplated that the base 30 may be affixed to the frame in dispenser embodiments lacking arms of the type described herein. The plunger 28 may be discrete unit and the base 30 may be adhered, joint, connected or otherwise affixed to the arms of the dispenser. For example, the base of the plunger may be attached by glues, welds, bolts, screws, pins, fasteners, clips, or other means. Alternatively, the plunger may be formed as an integral part of the outer arms, central arms or the frame by the same manufacturing techniques used to form the arms and/or frame. For example, the plunger may be formed as part of the arms and/or frame during a process such as, for example, injection molding, casting, machining, sculpting, or the like.

The distal end 32 of the plunger 28 may have a radius of curvature and desirably defines a hemisphere. The rounded tip serves as a centering device for loading the roll and eases loading by providing a leading edge. Of course, other geometries are contemplated for the shape of the distal end of the plunger.

The central shaft 34 of the plunger 28 connects the base 30 and the distal end 32 and provides sufficient length so the plunger 28 has a length at least as great as its widest dimension so the plunger is adapted to penetrate a depression defined at an end of a coreless roll product such that radial displacement of the coreless roll with respect to said frame is prevented during use.

Generally speaking, it is desirable for the plunger to have a cross-sectional width that is slightly greater than the width of the depression in the end of the coreless roll product. This configuration helps secure the roll when loaded, prevents overspin of the roll during dispensing, and assists in holding the roll as the roll is depleted. For example, if the depressions defined in both ends of the coreless roll have a diameter of slightly less than 1 centimeter (e.g., ~0.9 cm) the plunger desirably will have a diameter or width of about 1 centimeter or slightly greater than 1 centimeter.

In an embodiment of the invention, it is desirable that the plunger has a cross-section width of at least 1 centimeter (approximately ½ inch). If the plunger has a circular cross-section, it is desirable that the diameter be at least 1 centimeter. Desirably, the central shaft 34 has straight, parallel sides. The straight sides of the plunger help keep the roll from wobbling during dispensing, help the roll rotate freely and avoid damage to the roll during dispensing. It is also contemplated that the plunger may have a narrow width or a variable width.

The plunger may be configured so it essentially fixed or unable to rotate about an axis. In such case, it is desirable that the plunger be constructed of materials providing low levels of friction to allow the coreless roll to rotate freely. Alternatively, the plunger may be configured so it may rotate freely. It is contemplated that the plunger may be configured so it is able to rotate with the coreless roll during dispensing.

Referring again to FIG. 1, a number of plungers 28 extend from the respective arms 20, 22, and 24 toward where the coreless roll 12 of product will be held during operation. These plungers 28 are specifically designed to penetrate the depressions defined at each end of the coreless roll to secure the coreless roll against pilferage and to prevent radial displacement of the coreless roll during use.

In embodiments of the invention where the arms 20 and 24 are constructed out of resilient material, it will be appreciated that the biasing provided by the resiliency of arms will aid the plungers 28 in penetrating depressions defined at the ends of the coreless roll and enhance the securement of the coreless rolls within the dispenser 10 during use.

In other embodiments where the arms 20 and 24 are constructed out of a rigid material and a hinge or pivot is used, a resilient means such as a spring or rubber strip may be used to help the bias the arms toward the coreless roll.

Desirably, the dispenser 10 includes a cover 30 that is hinged to the frame 14 by hinges 32. A sliding window 34 may be provided in the cover 30 to selectively expose the roll 12 of coreless roll product that is being dispensed at a particular point in time, and to deny access to the other roll or vacated mounting location. The cover 30, hinges 32, and the sliding window 34 are conventional.

The cover 30 may also function as a locking means to help secure the coreless roll 12 in the dispenser. Closing the cover over the dispenser can prevent movement of the outer arms 20 and 24 so the coreless roll 12 cannot be unloaded and remains in place until it is depleted.

Figure 3:
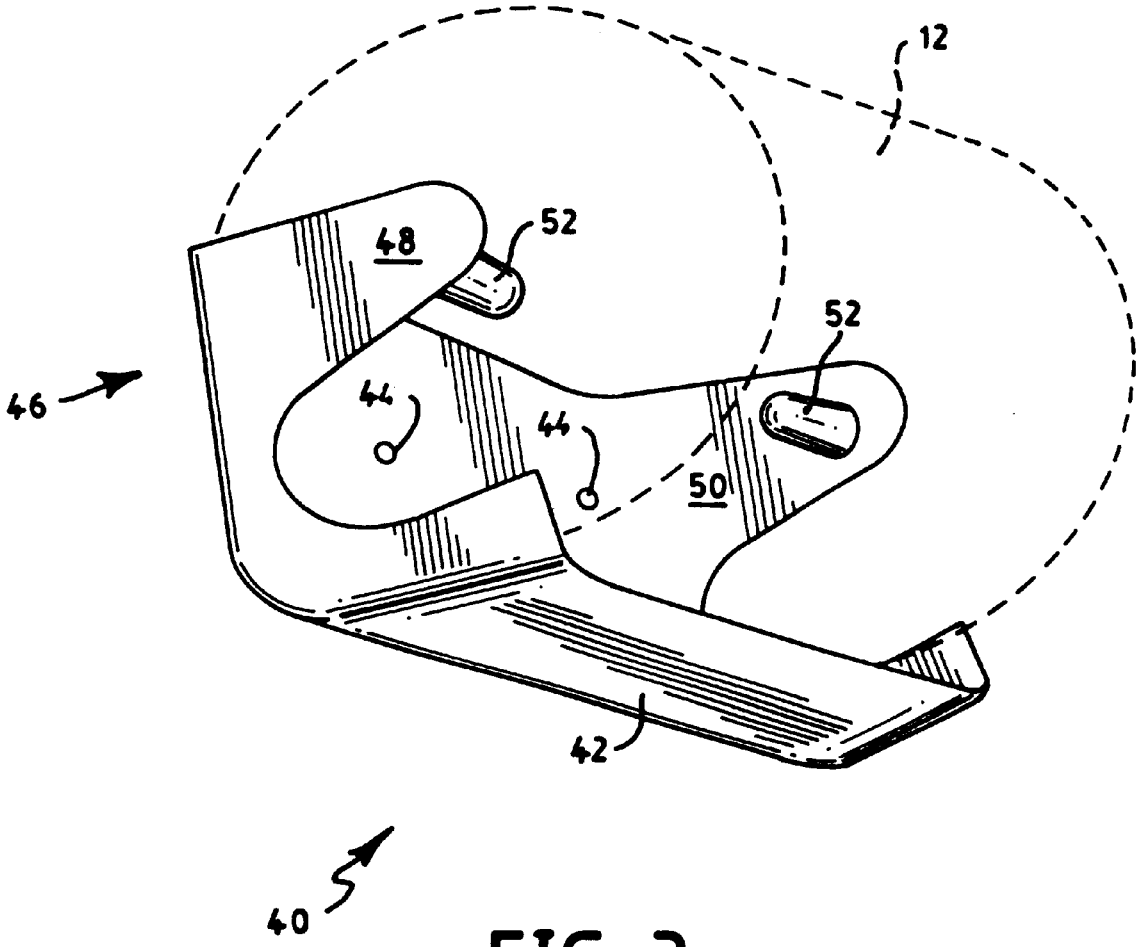
FIG. 3 is an illustration of an exemplary coreless roll product dispenser.

Referring now to FIG. 3, there is shown another embodiment of the present invention. FIG. 3 illustrate an exemplary dispenser 40 for dispensing a coreless roll 12 of product. The dispenser 40 includes a frame 42, which is embodied as a relatively simplified shield about the space where the coreless roll 12 will be positioned during use. The frame 42 has mounting holes 44 defined in a rear portion thereof for mounting the dispenser 40 to a stationary surface, such as a wall. The dispenser 40 further includes a coreless roll securing mechanism 46 that is embodied as a first arm 48 and a second arm 50 constructed of a resilient material. A pair of plungers 52 mounted to the respective resilient arms 48, 50 are constructed and arranged to penetrate into the depressions defined at the ends of the coreless roll in the manner described above. It is contemplated that the plungers 52 may be molded, formed, cast, welded or otherwise constructed as an integral part of the arms 48 and 52 instead of being discrete units mounted on the arms.

It is also contemplated that only one of the arms needs to be configured so that it is resilient to achieve satisfactory operation of the present invention (e.g., to load of the dispenser). Desirably, both arms 48, 50 will be resilient.

Figure 4:
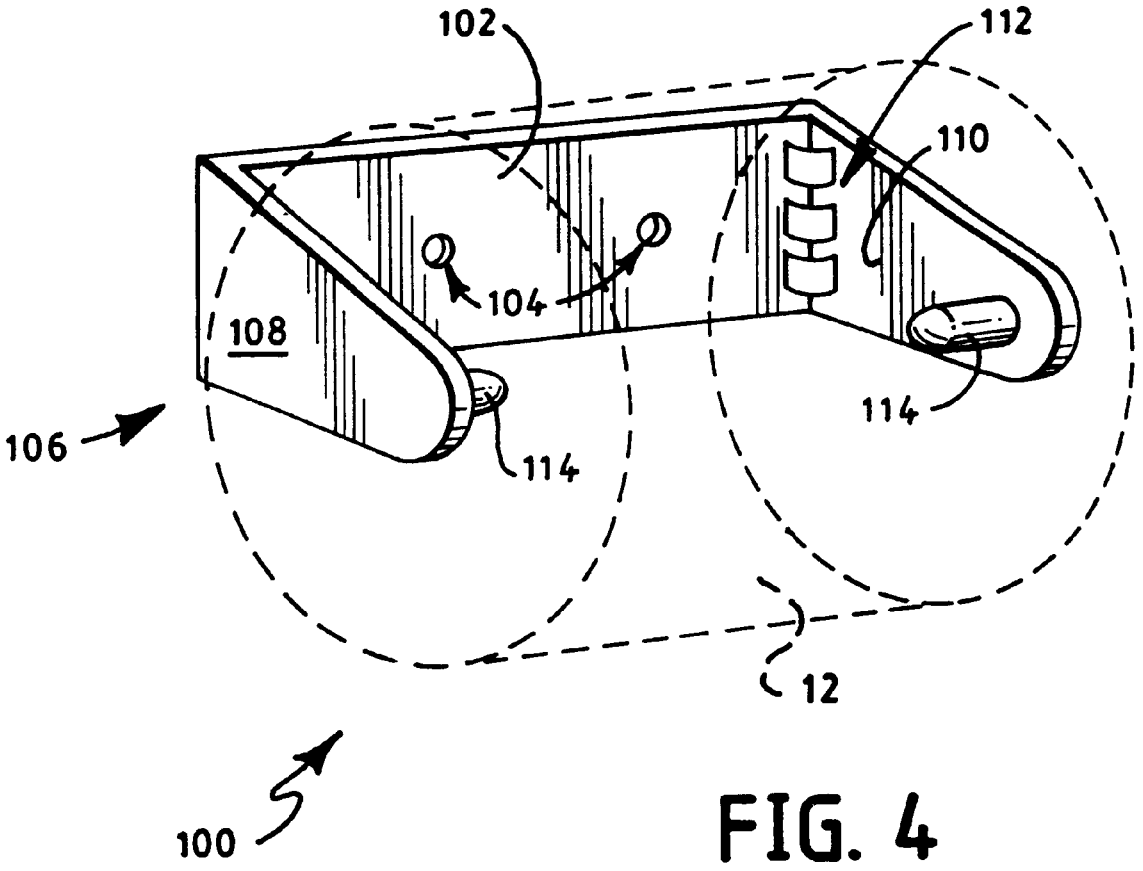
FIG. 4 is an illustration of an exemplary coreless roll product dispenser.
Figure 5:
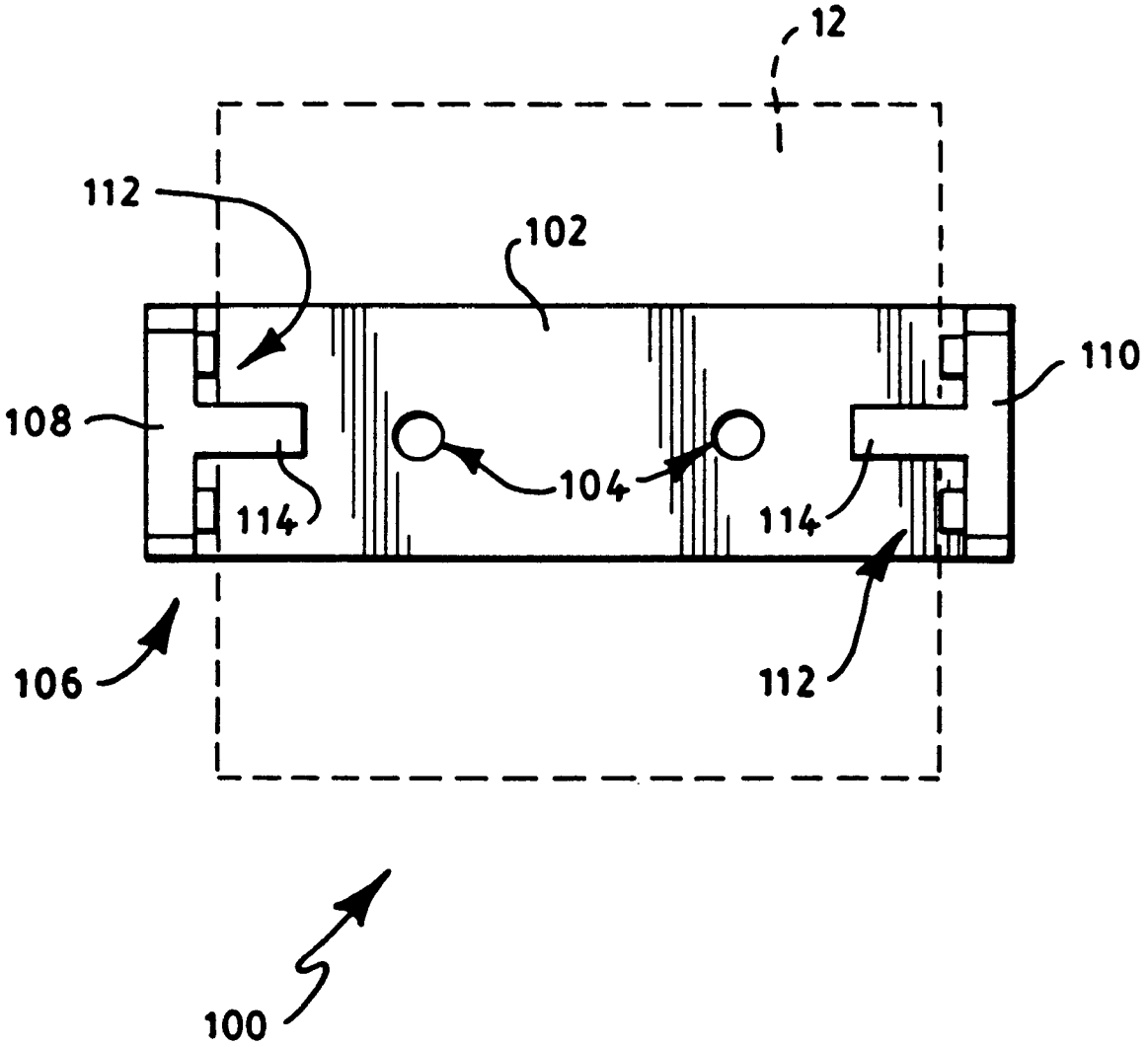
FIG. 5 is an illustration showing the front view of the exemplary coreless roll product dispenser of FIG. 4.

Referring now to FIGS. 4 and 5, there is shown another embodiment of the present invention. FIGS. 4 and 5 illustrate an exemplary dispenser 100 for dispensing a coreless roll 12 of product. The dispenser 100 includes a frame 102, which is essentially a mounting plate. The frame 102 has mounting holes 104 defined in a rear portion thereof for mounting the dispenser 100 to a stationary surface, such as a wall. The dispenser 100 further includes a coreless roll securing mechanism 106 that is embodied as a first arm 108 and a second arm 110. A pair of hinges or pivots 112 connect the first arm 108 and the second arm 110 to the frame 104.

A pair of plungers 114 mounted to the respective arms 108, 110 are constructed and arranged to penetrate into the depressions defined at the ends of the coreless roll in the manner described above. It is contemplated that the plungers 114 may be molded, formed, cast, welded or otherwise constructed as an integral part of the arms 108 and 110 instead of being discrete units mounted on the arms.

It is contemplated that only one of the arms 108, 110 needs to be configured so that it may be opened to a loading position and closed to a dispensing position to achieve satisfactory operation of the present invention (e.g., to load of the dispenser). Both of the arms 108, 110 may be configured so they hinge or pivot.

In other embodiments of the invention, a locking means for holding the arms 108, 110 in a dispensing position may be included in the dispenser. The locking means may be a cam, lever, ratchet, cotter pin or the like. The locking means may be activated by a key or pin. Such a locking means would be desirable for dispensers used in environments where pilferage of product may be encountered. The locking means on the plunger would discourage unloading of the coreless roll by making it difficult to pull the plungers out of the depressions defined in the ends of the coreless roll product.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An assembly for dispensing a coreless roll of an absorbent product wound to define a coreless cylindrical structure having end faces positioned at opposite axial ends of the structure, each end face having a depression defined therein, the assembly comprising:

a frame;

mounting means supported by the frame and configured to permit the frame to be mounted to a stationary surface such as a wall; and a coreless roll securing means supported by the frame and configured to secure the coreless roll for rotation within the frame, the coreless roll securing means comprising a pair of cooperating non-rotatable plungers, each plunger including a base supported by the frame and a distal end having a radius of curvature, a central shaft extending between and connecting the distal end and the base, the central shaft being configured to have a length at least as great as the plunger's widest dimension, the distal end of each plunger being supported to penetrate the depression defined at an end face of the coreless roll, the plunger having a cross-sectional width greater than the width of the depression in an end face of the coreless roll, whereby the frame and coreless roll securing means cooperate to prevent radial displacement of the coreless roll with respect to the frame during a dispensing operation.

2. The assembly of claim 1, wherein the mounting means comprises a portion of the frame formed to include an opening for a securing member such as a bolt.

3. The assembly of claim 1, wherein the coreless roll securing means further comprises a pair of opposed side arms connected to the frame, each arm having an inner side and an outer side, each inner side configured to support a plunger.

4. The assembly of claim 3, further comprising biasing means for resiliently biasing at least one of the opposed arms toward the coreless roll mounted between the opposed arms.

5. The assembly of claim 4, wherein the biasing means comprises at least one of the opposed arms constructed from a resilient material and the at least one arm configured to be slightly deformed toward a coreless roll when the coreless roll is secured within the dispenser.

6. The assembly of claim 3, wherein the pair of opposed arms is structured to pivot apart from each other to define a loading position and to pivot toward each other to define a dispensing position.

7. The assembly of claim 6, further comprising a locking means for locking the opposed arms in the dispensing position.

8. The assembly of claim 7, wherein the locking means comprises a cover that surrounds the opposed arms.

9. The assembly of claim 1, wherein each plunger has a circular cross-section.

10. The assembly of claim 1, wherein each plunger has a cross-section diameter of at least 1 centimeter.

11. The assembly of claim 1, wherein the distal end of each plunger defines a hemisphere.

12. The assembly of claim 1, wherein the distal end of each plunger extends from the plunger's base a distance that is from about 1.0 to about 2.0 times the width of the plunger.

13. A method of installing a coreless roll of an absorbent consumer paper product wound to define a coreless cylindrical structure having end faces positioned at opposite axial ends of the structure, each end face having a depression defined therein thereby permitting the roll to be disposed into a dispenser, the method including the steps of:

displacing at least one of a pair of opposed non-rotatable plungers to a loading position, each plunger having a cross-sectional width greater than a width of a depression in a roll;

orienting the coreless roll so that each depression is adjacent one plunger; and securing the coreless roll to the dispenser by returning the at least one of the pair of opposed plungers to a dispensing position whereby the plungers cooperate by penetrating the respective depressions in the coreless roll, the width of each plunger preventing overspin of the roll during a dispensing operation.

14. The method of claim 13, wherein the displacing step includes displacing both of the opposed plungers into a loading position.

15. The method of claim 14, wherein the securing step includes returning both of the opposed plungers to a dispensing position.

16. The method of claim 13, further including the step of resiliently biasing the plungers into the coreless roll during the dispensing operation.

17. The method of claim 13, wherein the displacing and securing steps involve moving at least one of a pair of opposed arms.

18. The method of claim 17, wherein the displacing and securing steps involve moving a pair of opposed arms.

19. The method of claim 17, further comprising the step of locking at least one of a pair of opposed arms in a dispensing position.

20. A paper product dispensing system comprising:

a coreless roll of a sheet material of an absorbent consumer paper product wound to define a coreless cylindrical structure having end faces positioned at opposite axial ends of the structure, each end face having a depression defined therein;

an assembly comprising:

a frame;

mounting means supported by the frame and configured to permit the frame to be mounted to a stationary surface such as a wall; and a coreless roll securing means supported by the frame and configured to secure a coreless roll for rotation within the frame, the coreless roll securing means comprising a pair of opposed arms extending from the frame, at least one arm being configured to provide movement with respect to the frame; and a pair of cooperating non-rotatable plungers, each plunger including a base supported by one of the arms and a distal end having a radius of curvature, a central shaft extending between and connecting the distal end and the base, the central shaft being configured to have a length at least as great as the plunger's widest dimension, the distal end of each plunger supported by its respective arm to penetrate the depression defined at an end face of the coreless roll, each plunger configured to have a cross-sectional width greater than the width of the depression in an end face of the coreless roll to prevent overspin of the roll during dispensing, the pair of opposed arms and plungers configured to cooperate with the depressions in the coreless roll to prevent radial displacement of the coreless roll with respect to the frame during a dispensing operation.

* * * * *